US007342159B2

(12) United States Patent
Podlipny

(10) Patent No.: US 7,342,159 B2
(45) Date of Patent: Mar. 11, 2008

(54) GRAND PIANO ACTION MECHANISM

(75) Inventor: Jiri Podlipny, Smirice (CZ)

(73) Assignee: Petrof, spol. s.r.o., Hradec Kralove (CZ)

( * ) Notice: Subject to any disclaimer, the term of this patent is extended or adjusted under 35 U.S.C. 154(b) by 98 days.

(21) Appl. No.: 10/578,911

(22) PCT Filed: Apr. 28, 2005

(86) PCT No.: PCT/CZ2005/000036

§ 371 (c)(1),
(2), (4) Date: May 9, 2006

(87) PCT Pub. No.: WO2005/106838

PCT Pub. Date: Nov. 10, 2005

(65) Prior Publication Data

US 2007/0101852 A1 May 10, 2007

(30) Foreign Application Priority Data

Apr. 28, 2004 (CZ) ..... PV2004-542

(51) Int. Cl.
*G10C 3/00* (2006.01)

(52) U.S. Cl. ..... 84/216; 84/216; 84/69

(58) Field of Classification Search ..... 84/216, 84/69

See application file for complete search history.

(56) References Cited

U.S. PATENT DOCUMENTS 2,976,756 A * 3/1961 Schwarzbaur ..... 84/216
4,957,029 A * 9/1990 Kahonen ..... 84/384
5,796,024 A 8/1998 Stanwood et al.
6,730,839 B2 * 5/2004 Itou ..... 84/719

FOREIGN PATENT DOCUMENTS

| | | | |
|---|---|---|---|
| CN | 1691132 A | * | 11/2005 |
| GB | 2331831 A | * | 2/1999 |
| JP | 10055171 A | * | 2/1998 |
| NL | 1022822 C | * | 9/2004 |
| WO | 00/54248 A | | 9/2000 |

OTHER PUBLICATIONS

Patent Abstracts of Japan vol. 2003, No. 9, Sep. 3, 2003 & JP 2003 10640 A (Kawai Musical Instr Mgf Co Ltd), May 16, 2003.

International Search Report and Written Opinion issued in corresponding PCT/CZ2005/000036.

* cited by examiner

*Primary Examiner*—Lincoln Donovan
*Assistant Examiner*—Robert W. Horn
(74) *Attorney, Agent, or Firm*—Buchanan Ingersoll & Rooney PC

(57) ABSTRACT

An action mechanism of a mechanical piano including a wippen accommodated on a wippen rail, a repetition lever with a flange, a jack, a hammer, and a pair of permanent magnets arranged so as to repel each other. The first magnet is attached to the wippen and the second magnet is attached to immovable structure of the piano.

6 Claims, 1 Drawing Sheet

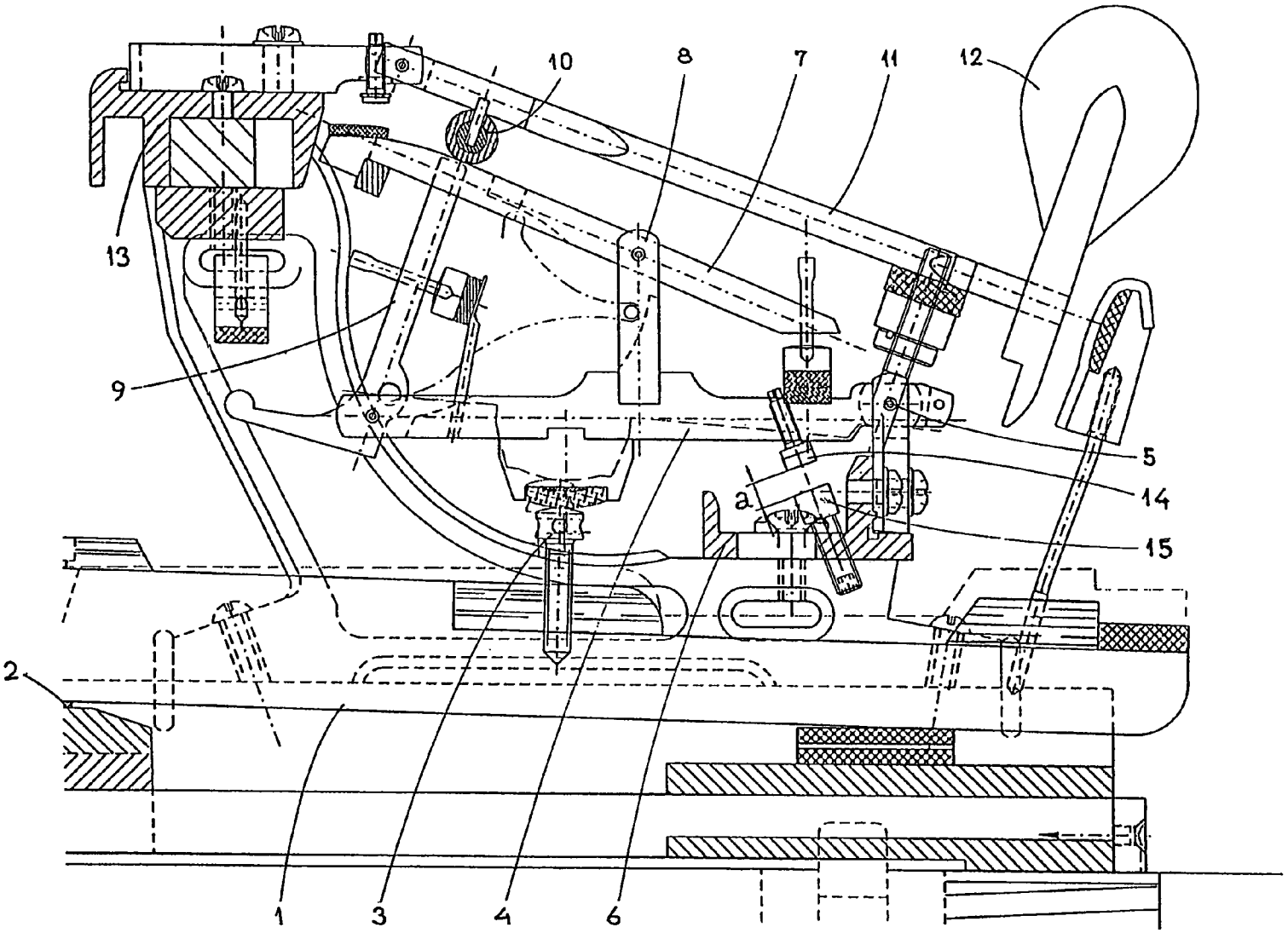
1
2
3
4
5
6
7
8
9
10
11
12
13
14
15
a

GRAND PIANO ACTION MECHANISM

TECHNICAL FIELD

The invention relates to the action mechanism of a mechanical piano consisting, among others, of a key, a wippen, a repetition lever, a jack and a hammer, and comprising a pair of permanent magnets that are arranged so as to repulse each other, the first magnet being attached to the wippen and the second magnet to the immovable structure of the piano.

PRIOR ART

The historical development has considerably unified the design of the action mechanism of grand pianos, resulting in only minor differences existing between the mechanical systems used by different manufacturers of today. The task of a piano mechanism resides, among others, in transferring the motion of a key to a hammer impacting upon the respective string or strings. The mechanism in use represents a considerably sophisticated design that should comply with a number of requirements, involving the task to make the performance pleasant, agreeable, and definite. The keys should present the same resistance in all positions of the keyboard. The movement of the key, which is a double acting lever, is transmitted by a capstan screw attached to said key onto a wippen accommodated pivotably on a wippen rail and therefrom, by way of a repetition lever and a jack, the motion is transmitted to a hammer shank that pivots on a hammer flange rail. This mechanism is the same in all keys of the keyboard, however, it differs as to the hammer mass, and namely within the range between 14 g for the bass position down to 4 g in the descant position. The keys at the side of the mechanism act upon the hammers by these different masses. In order to cope with the requirement that the key resistance should be the same over the whole keyboard, these differences of mass should be compensated for. In known piano mechanisms such compensation, or balancing, is implemented by inserting leaden rollers into the keys at the side of the keyboard. Adding weights helps to achieve static balancing of the key mechanism, but its dynamic characteristics are considerably impaired. The piano player will feel it in particular during quick repetitions of the tones, since especially deep tones require imparting acceleration to rather high inertia masses. Another disadvantage of the known balancing of the piano mechanism is the utilisation of lead, which is due to the necessity of concentrating the weights into the small space available.

Efforts are known to improve the features of the piano mechanism by way of permanent magnets accommodated on various parts thereof. E.g., patent specification No NL 1011484 suggest to locate pairs of permanent magnets under the key at both sides of the balance rail. But practice shows that this results into the necessity of increasing the mass of weights to ensure the stability of the key.

A more prospective solution of the problem is proposed in patent specification JP 2003140640. A permanent magnet is installed at the end of the wippen overlapping over the bearing of the wippen, and namely at its upper side. Such magnet co-operates with a magnet that is accommodated on the immovable structure above the wippen. The magnets act against the gravity of the wippen mass and the attached parts affecting the key, thus reducing the need for weights in the keys at the side of the keyboard. Their drawback, however, resides in that the magnets push the wippen downwards, burdening its bearing, whereas the short overlapping end of the wippen allows to install the magnets at a short distance only, i.e. about 10 mm from the bearing. Due to that the stroke of the movable magnet is very small and the repulsive force between both magnets is present almost throughout the whole time of action. This is seen to substantially impact the dynamism of the piano mechanism over the whole part of hammer movement. Thus the feeling of the piano player changes in the sense of limiting the possibility of substantially varying the play dynamics. In addition to that, locating the upper fixed magnet to the envisaged spot presents considerable problems from the viewpoint of design. These may be the reasons for which no pianos implementing such solution have appeared in the market down to the present day.

It is the aim of the present inventions to improve the dynamic characteristics of the known piano mechanism with permanent magnets.

SUMMARY OF THE INVENTION

The above task is solved by a grand piano action mechanism consisting, among others, of a key, a wippen accommodated on a wippen rail, a repetition lever with a flange, a jack and a hammer, and comprising a pair of permanent magnets that are arranged so as to repulse each other, the first magnet being attached to the wippen and the second magnet to the immovable structure of the piano. The substance of this action mechanism resides in that the first magnet is attached to the bottom of the wippen between the wippen center pin and the repetition lever flange, whereas the second magnet is attached to the wippen rail.

A preferable embodiment in the light of dynamics has magnets close to a centre pin of the wippen, at best within a distance between 15 to 25 mm.

For adjusting optimum dynamic effects, at least one of the magnets can be provided with means for adjusting its distance from the other magnet.

BRIEF DESCRIPTION OF THE DRAWING

The invention will be more readily understood by way of a drawing representing a preferred embodiment of a piano mechanism for one key. A dashed line represents the contour of that key and the wippen in raised position.

DETAILED DESCRIPTION OF PREFERRED EMBODIMENT

Parts of the piano mechanism according to the picture affected by the invention are the following: a key 1, which is a double acting lever supported on a balance rail 2, fixed to the key 1 is a capstan screw 3, that lifts, upon depressing key 1, a wippen 4 pivotably accommodated at a wippen centre pin 5 on a wippen rail 6, further a repetition lever 7 that pivots on a repetition lever flange 8 that is attached to wippen 4, a jack 9 that lifts a hammer shank 11 with a knuckle 10, and a hammer 12 that is pivotably accommodated on a hammer flange rail 13. Upon depressing key 1, the mechanism throws hammer 12 against the string. Strings for different heights of tone require corresponding weights of hammer 12. The mass of hammer 12 lies on key 1 by the intermediary of the mechanism. For balancing the effects of different weights along the length of the keyboard the keys 1 are provided with weights at the side of the keyboard. In the direction to the deep tones the mass of these weights increases. Being thus statically balanced, keys 1 of the keyboard present the same resistance to the fingers during their slow depression. During quick depressions, however, especially in case of fast repetitions of the same tone, the dynamic effects of the masses that should be imparted acceleration by the finger, show adverse results. The design of the mechanism according to the present invention substitutes the effect of weights with the effect of a pair of co-axial permanent magnets 14, 15 arranged so as to repulse each other. The first magnet 14 is attached to the bottom of wippen 4 between the wippen centre pin 5 and the accommodation of the repetition lever flange 8, the second magnet 15 is attached to the wippen rail 6. Both magnets 14, 15 that are arranged about 20 mm from wippen centre pin 5 are screwed to the mentioned part of the mechanism, with the option of adjusting their axial position, i.e. their distance a. This allows to regulate the release of the wippen 4.

The piano mechanism according to the present invention allows to reduce substantially the weight mass and to refrain to the full from the utilisation of the lead weights. For deeper positions brass weights of smaller mass will do, whereas the mass of the key for the higher tones can be reduced by drilling holes in its front part. The relatively large stroke of the movable magnet and its deviation during the stroke result in that the relieving effect is manifested only during a short phase of striking the key, the contact of the piano player with the dynamism of the hammer movement being retained. Also during the return of the hammer to its initial position the braking effect sets in at the very end, without affecting the velocity of the hammer. The feeling of the piano player, accordingly, is the one he/she is used to, but playing is easier.

The invention claimed is:

1. A grand piano action mechanism, comprising a key, a wippen accommodated on a wippen rail, a repetition lever with a flange, a jack, a hammer and first and second permanent magnets that are arranged so as to repulse each other, the first magnet is attached to the wippen and the second magnet is attached to an immovable piano structure, wherein the first magnet is attached to the bottom of the wippen between a wippen center pin and the repetition lever flange, and the second magnet is attached to the wippen rail.

2. The grand piano action mechanism according to claim 1, wherein the first and second magnets are arranged within 15 to 25 mm from the center pin of wippen.

3. The grand piano action mechanism according to claim 1, wherein at least one of the first and second magnets is provided with means for adjusting the distance from the other magnet.

4. The grand piano action mechanism according to claim 2, wherein at least one of the first and second magnets is provided with means for adjusting the distance from the other magnet.

5. The grand piano action mechanism according to claim 1, wherein the first magnet is screwed to the bottom of the wippen and the second magnet is screwed to the wippen rail such that the distance between the first and second magnets is adjustable.

6. The grand piano action mechanism according to claim 2, wherein the first magnet is screwed to the bottom of the wippen and the second magnet is screwed to the wippen rail such that the distance between the first and second magnets is adjustable.

* * * * *